US009506150B2

(12) United States Patent
Weitershaus et al.

(10) Patent No.: US 9,506,150 B2
(45) Date of Patent: Nov. 29, 2016

(54) METALLIZATION INHIBITORS FOR PLASTISOL COATED PLATING TOOLS

(71) Applicant: Rohm and Haas Electronic Materials LLC, Marlborough, MA (US)

(72) Inventors: Katharina Weitershaus, Kriens (CH); Andreas Scheybal, Zurich (CH); Wan Zhang-Beglinger, Adligenswil (CH)

(73) Assignee: Rohm and Haas Electronic Materials LLC

( * ) Notice: Subject to any disclaimer, the term of this patent is extended or adjusted under 35 U.S.C. 154(b) by 0 days.

(21) Appl. No.: 14/872,201

(22) Filed: Oct. 1, 2015

(65) Prior Publication Data

US 2016/0102403 A1 Apr. 14, 2016

Related U.S. Application Data

(60) Provisional application No. 62/063,384, filed on Oct. 13, 2014.

(51) Int. Cl.

| | |
|---|---|
| ***C23C 18/31*** | (2006.01) |
| ***C23C 18/20*** | (2006.01) |
| ***C23C 18/16*** | (2006.01) |
| ***C23C 18/24*** | (2006.01) |
| ***C23C 18/30*** | (2006.01) |
| ***C23C 18/22*** | (2006.01) |

(52) U.S. Cl.

CPC ..... *C23C 18/31* (2013.01); *C23C 18/163* (2013.01); *C23C 18/1625* (2013.01); *C23C 18/2046* (2013.01); *C23C 18/22* (2013.01); *C23C 18/24* (2013.01); *C23C 18/30* (2013.01)

(58) Field of Classification Search

CPC . C23C 18/31; C23C 18/1625; C23C 18/163; C23C 18/2046; C23C 18/22; C23C 18/24; C23C 18/30

See application file for complete search history.

(56) References Cited

U.S. PATENT DOCUMENTS

| | | | | |
|---|---|---|---|---|
| 3,443,988 | A | 5/1969 | McCormack et al. | |
| 3,939,056 | A | 2/1976 | Fueki et al. | |
| 6,926,922 | B2 | 8/2005 | Leung et al. | |
| 7,405,264 | B2 | 7/2008 | Yuasa et al. | |
| 7,780,771 | B2 | 8/2010 | Scaraglino et al. | |
| 8,530,574 | B2 | 9/2013 | Balk et al. | |
| 2005/0199587 | A1* | 9/2005 | Bengston | C23C 18/22 216/83 |
| 2005/1099587 | | 9/2005 | Jon Bengston | |
| 2013/0048197 | A1 | 2/2013 | Schram et al. | |
| 2013/0230657 | A1 | 9/2013 | Milum et al. | |
| 2014/0000476 | A1 | 1/2014 | Portet et al. | |
| 2015/0233011 | A1* | 8/2015 | Herdman | C25D 17/08 205/183 |

FOREIGN PATENT DOCUMENTS

| | | | |
|---|---|---|---|
| EP | 0607717 | A2 | 7/1994 |
| EP | 2197253 | | 6/2010 |
| EP | 1496090 | B1 | 12/2011 |
| FR | 2456131 | A1 | 5/1980 |
| JP | 2007092111 | | 4/2007 |
| WO | 2009023628 | A2 | 2/2009 |
| WO | 2013135862 | A2 | 9/2013 |
| WO | 2013182590 | A1 | 12/2013 |
| WO | 2015126544 | | 8/2015 |

OTHER PUBLICATIONS

Corresponding EP 14189091.0-1359 Search Report dated Dec. 23, 2015.

* cited by examiner

*Primary Examiner* — Duy Deo

(74) *Attorney, Agent, or Firm* — John J. Piskorski

(57) ABSTRACT

The plastisol coated plating tools are used to secure polymer containing substrates in electroless plating baths during electroless plating of the polymers. To prevent metallization of the plastisol coated plating tools during electroless metallization, compositions of sulfur compounds are applied to the plastisol. After metallization the plastisol coated plating tools may be re-used without the need to strip the unwanted metal from the tools.

12 Claims, No Drawings

METALLIZATION INHIBITORS FOR PLASTISOL COATED PLATING TOOLS

FIELD OF THE INVENTION

The present invention is directed to metallization inhibitors for plastisol coated plating tools used in the electroless metallization of polymer containing substrates. More specifically, the present invention is directed to metallization inhibitors for plastisol coated plating tools used in the electroless metallization of polymer containing substrates where the metallization inhibitors are sulfur containing compounds.

BACKGROUND OF THE INVENTION

A conventional method of pretreatment of non-conductive polymer surfaces prior to electroless metallization, typically electroless nickel plating or copper plating, includes etching the surface with chromium (VI) containing solutions followed by the activation with an ionic or colloidal solution of palladium compounds and either the reduction in sodium hypophosphite solution or acceleration in an acid solution such as sulfuric acid of palladium ions or colloidal palladium particles, respectively, adsorbed on the polymer surface.

Etching during a pretreatment step of the non-conductive substrate surface is required to obtain a hydrophilic and micro-roughened surface to allow sufficient quantities of palladium to adsorb on the surface and for ensuring proper binding of metal coatings to the non-conductive polymer surface. The activation with subsequent reduction or acceleration is performed in order to initiate the electroless deposition of the metal on the polymer. Thereafter, electroless plating with metal in the metallization solution takes place through auto-catalytic reaction where the metal deposited on the surface acts as a catalyst for electroless metal plating. Typically, electrolytic metal plating is performed on the first metal layer. Various metals can be applied such as chromium, nickel, copper, brass and other alloys of the foregoing metals.

Typically, polymer surfaces are treated with chromium (VI) containing pickling solutions which can be divided into solutions with high and low chromic acid content. For example such solutions which are based on chromium-sulfuric acid with high chromic acid content can include chromium (VI) oxide from 200 g/L to 550 g/L and sulfuric acid from 200 g/L to 500 g/L. Solutions with low chromic acid content contain less than 100 g/L chromic acid but the sulfuric acid content is at least 500 g/L.

The primary problems of the conventional method are related to the carcinogenic nature of the chromic acid solutions. Furthermore, low chromic acid containing etching solutions are prone to cause some metal deposition during electroless metallization, for example nickel, on the plating tools insulated with plastisol used in the metallization process. This can cause undesired plating with subsequent metal layers on the rack as well as contamination of subsequent plating by dissolving electroless metal layers from the rack.

Various methods to avoid the use of the carcinogenic chromic acid in the pretreatment of polymers have been suggested. U.S. 2005/0199587 discloses a method of etching non-conductive polymer surfaces in an acidic solution containing 20 g/L to 70 g/L of potassium permanganate. Optimal potassium permanganate concentration of the above mentioned solution is close to 50 g/L. When the concentration is below 20 g/L, the solution is ineffective with the upper concentration limit determined by the solubility of potassium permanganate. The etching is followed by the activation in a palladium solution containing amine and by further treatment in borohydride, hypophosphite or hydrazine solution.

The method, however, has substantial shortcomings. At high permanganate concentrations of around 50 g/L with phosphoric acid at around 48% v/v the etching solution quickly decomposes, especially at high temperatures of around 37° C. Often the solution has to be replenished with permanganate. Furthermore, insoluble permanganate decomposition products are formed contaminating the surface being metallized.

Etching in the permanganate solutions activates the plastisol surface of plating tools as it is coated with the product of the etching solution, i.e., manganese dioxide. The later stimulates adsorption of palladium compounds on the plastisol which tends to metallize in the electroless metal plating solutions. Formation of manganese dioxide on surfaces is characteristic of the permanganate etching solutions of any composition.

Accordingly, there is still a need for a method of inhibiting metallization of plastisol coated plating tools during electroless metal plating.

SUMMARY OF THE INVENTION

Methods include providing a plating tool comprising plastisol; applying a composition comprising a sulfur compound containing a sulfur atom in an oxidation state equal to −1 or −2 or a mixture of sulfur compounds having sulfur atoms with oxidation states of −1 and −2 to the plastisol; fastening a substrate comprising one or more polymers to the plating tool; etching the one or more polymers of the polymer with a chromium (VI) free etch or low chromic acid etch composition; applying a catalyst to the one or more polymers; and electroless plating a metal on the one or more polymers.

Treating the plastisol coated plating tools with a composition containing one or more sulfur compounds containing a sulfur atom in an oxidation state equal to −1 or −2 inhibits unwanted metallization of the plastisol coated plating tools. In addition, the methods may be used with etching solutions which exclude carcinogens such as chromium (VI) and are more environmentally friendly.

DETAILED DESCRIPTION OF THE INVENTION

As used throughout this specification, the abbreviations given below have the following meanings unless the context clearly indicates otherwise: ° C.=degrees Centigrade; g=gram; L=liter; mL=milliliters; g/L=grams per liter; m=meters; A=amperes; dm=decimeter; ASD=ampere/$dm^2$; wt %=percent by weight; v/v %=volume percent; kg=kilograms; HLB=hydrophilic-lipophilic balance; Mn(II)=manganese two oxidation state; Mn(III)=manganese three oxidation state; Cr(III)=chromium three oxidation state; Cr(VI)=chromium six oxidation state; Cr=chromium; Pd=palladium; Ag=silver; Bi=bismuth; Ce=cerium; Pb=lead; ABS=Acrylonitrile butadiene styrene; PVC=polyvinyl chloride; PEG=polyethylene glycol; PP=polypropylene; EO=ethyleneoxide; PO=propylene oxide; and EO/PO=ethylene oxide/propylene oxide.

The terms "plating" and "deposition" are used interchangeably throughout this specification. All amounts are percent by weight, unless otherwise noted. The term "a" or "an" refers to the singular and the plural. All numerical ranges are inclusive and combinable in any order except where it is logical that such numerical ranges are constrained to add up to 100%.

Compositions include a sulfur compound containing a sulfur atom in an oxidation state equal to −1 or −2. Two or more sulfur compounds having an oxidation state of −1 or −2 or mixtures of sulfur compounds having the two oxidation states may be included in the compositions. Preferably the sulfur atom has an oxidation state of −2. The sulfur compounds are included in the compositions in amounts of 0.1 g/L to 200 g/L, preferably 5 g/L to 100 g/L, more preferably from 20 g/L to 80 g/L.

Sulfur compounds where the sulfur atom has an oxidation state of −1 include, but are not limited to disulfides. Disulfides include, but are not limited to di-n-allyl-disulfide, di-n-hexyl-disulfide, di-isopropyl-disulfide, isopentyl disulfide, tert-heptyl disulfide, di-octyl-disulfide, di-undecyl disulfide, di-dodecyl disulfide, di-hexadecyl disulfide, di-Octadecyl disulfide, bis(16-Hydroxyhexadecyl) disulfide, bis(11-cyanoundecyl) disulfide, bis-(3-sulfopropyl)-disulfide (SPS), diphenyl-disulfide, dibenzyl disulfide, benzyl methyl disulfide, PEG-propionate disulfide, furfuryl disulfide, thiram, and disulfiram.

Sulfur compounds where the sulfur atom has an oxidation state of −2 include, but are not limited to thiols, thioethers, thiourethanes, dithiocarbamtes, thioester, dithioesters, thioureas, thioamides, and aromatic heterocyclic sulfur containing compounds.

Thiols include, but are not limited to hexyl mercaptan, cylcohexyl mercaptan, heptyl mercaptan, octyl mercaptan, nonyl mercaptan, decyl mercaptan, undecyl mercaptan, lauryl mercaptan, myristyl mercaptan, palmityl mercaptan, stearyl mercaptan, oleyl mercaptan, thiophenol, biphenyl-4-thiol, 1,4-benzenedimethanethiol, n-octadecyl-3-mercaptopropionate. Preferably thiol compounds include one thiol group per molecule and have a hydrophobic segment with 4-36 carbon atoms, preferably from 8-18 carbons. The hydrophobic segments may be saturated or unsaturated. Such thiols include, but are not limited to alkyl mercaptans such as butyl mercaptan, pentyl mercaptan, hexyl mercaptan, octyl mercaptan, decyl mercaptan, lauryl mercaptan, octadecyl mercaptan, myristyl mercaptan and palmityl mercaptan. Other thiol compounds having a hydrophobic segment include, but are not limited to compounds where the thiol and the hydrophobic group are bonded by an ester bond, amide bond or urethane bond. Ester bonded include, but are not limited to 2-ethylhexyl thioglycolate, isooctyl mercapto acetate, octyl thioglycolate, nonyl mercaptoacetate, methoxybutyl thioglycolate, dodecyl mercaptoacetate, isooctyl-3-mercaptopropionate, n-octyl mercaptopropionate, dodecyl-3-mercaptopropionate, octadecyl-3-mercaptopropionate, tridecyl-3-mercaptopropionate, and 2-mercaptoethyl octanoate ester. Amido bonded include but are not limited to N-2-mercaptoethyl-hexanamide, N-2-mercaptoethyl-octanamide, N-8-mercaptooctyl-octanamide, N-ethyl-7-mercaptooctanamide, and N-octadecyl-2-mercaptoacetamide. Urethane bonded include but are not limited to hexyl carbamic acid-2-mercaptoethyl ester, ethyl carbamic acid 2-mercaptoethyl ester, tert.-butyl carbamic acid-4 mercaptobutyl ester, isopropyl cabamic acid −3-mercaptopropyl ster, 8-mercaptooctyl carbamic acid butyl ester, and 18-mercaptooctadecyl carbamic acid ethyl ester.

Thioethers include, but are not limited to dibutyl sulfide, diphenyl sulfide, diallyl sulfide, dihexyl sulfide, diheptyl sulfide, dioctyl sulfide, didodecyl sulfide, dioctadecyl sulfide, dibenzyl sulfide, benzyl phenyl sulfide, and difurfuryl sulfide.

Thiourethanes include, but are not limited to S-butyl N-(2-ethyl-6-methylphenyl) thiocarbamate, S-butyl-N-(2,4-xylyl) thiocarbamate, S-(2-hydroxyethyl)-N-(3-chloro-2-methylphenyl) thiocarbamate, 5-(2-hydroxylphenyl)-N-(2-ethylphenyl) thiocarbamate, O-isopropyl thiocarbamate, O-2-(naphthyl)-methyl(phenyl) thiocarbamate, and esprocarb.

Dithiocarbamates include, but are not limited to N,N-diethyldithiocarbamate, 1,4-cyclohexane-bis-(dithiocarbamate) sodium salt, 1,4-phenylene-bis-(dithiocarbamate) sodium salt, dithiocarb, and dazomet.

Thioesters include, but are not limited to S-ethyl-thioacetate, S-ethyl-thiopropionate, S-methyl thiobutanoate, S-propyl ethanthioate, S-tert.-butyl thioacetate, methyl thiohexanoate, S-phenyl thioacetate, 2-(acetylthio)hexyl acetate, and S-(11-bromoundecyl) thioacetate.

Dithioesters include, but are not limited to 2-(phenylcarbonothioylthio)propanoic acid, naphthalene-1-carbodithioic acid methyl ester, and phenothiazine-10-carbodithioic acid methyl ester.

Thioureas include, but are not limited to 1,3-diisopropyl-2-thiourea, N,N'-dibutylthiourea, 1-(3-phenylpropyl)-2-thiourea, N, N'-diphenylthiourea, 1,3-dioctyl-2-thiourea, and 1-octyl-3-isopropyl-2-thiourea.

Thioamides include, but are not limited to thioacetamid, thiobenzamid, and thioacetanilid.

Aromatic heterocyclic sulfur containing compounds include, but are not limited to thiophenes, thiazoles, isothiazoles, benzothiazoles, benzoisothiazoles, thiadiazoles, dithiazoles, thiazines, and phenothiazines.

Preferably the sulfur containing compounds are chosen from thiols and disulfides. More preferably they are chosen from thiol compounds.

The compositions may include one or more organic solvents, water or mixtures thereof. The amount of the organic solvents may vary from 0 v/v % to 100 v/v %. 100 v/v % means that the sulfur compound is dissolved only in organic solvent and 0 v/v % means that no organic solvent is added to the sulfur compound. When no organic solvent is present the solvent may be water. Organic solvents include, but are not limited to n-pentane, n-hexane, cyclohexane, petroleum ether, methanol, ethanol, iso-propyl alcohol, n-propanol, n-butanol, diethylether, methyl-tert.-butylether, iso-propyl-ether, tetrahydofuran, 1,4-dioxan, acetone, chloroform, dichloromethane, tetrachloromethane, trichloroethylene, acetonitrile, ethylacetate and acetic acid.

The compositions may also include one or more emulsifying agents. Emulsifiers include, but are not limited to conventional non-ionic oil-in-water emulsifiers with an HLB range of 5 to 15, such as: EO, PO or EO/PO adducts of alcohols, fatty alcohols, oxoalcohols, fatty acids, triglyceride, thiols, amines, fatty amines, nonylphenols, octylphenols and alkylpolyglucosides. Such emulsifiers are available under various brand names known in the art and disclosed in the literature. Examples of commercial emulsifiers are Lutensol™, Aduxol™, Dehydol™ Glucopon™, Agnique™, Emulan™, Alcodet™, Plurafac™, Triton™, Tergitol™, Ecosurfr™, Rhodasurfr™, Alkamuls™, Adeka™ Tol, Adeka™ Estol, Surfonic™, Teric™ and Empilan™ Emulsifiers are added in amounts of 5 g/L to 200 g/L, preferably 30 g/l to 100 g/L.

The compositions inhibit metallization of plating tools coated in plastisol. Typically the plating tool is a mounting rack which secures a substrate to be plated in the plating solution during the plating process. However, it is envisioned that the compositions may be applied to any tool or article coated with plastisol which comes in contact with a metal plating solution during metallization where metal deposits are not desired. The compositions may be applied to the plastisol coating by any suitable process which coats the plastisol in at least areas which are exposed to plating baths during the plating process. For example, the plating tools may be immersed in the composition, the composition may be sprayed on the plastisol or the composition may be painted on the plastisol using a brush. The compositions are typically applied to the plastisol at temperatures from room temperature to 60° C.

A plastisol is typically a mixture made up of at least one powder suspension of a polyvinyl chloride polymer prepared according to an emulsion polymerization procedure or micro-suspension in a liquid plasticizer. Typical plastisols include at least one polyvinyl chloride (PVC) polymer such as polyvinyl chloride/polyvinyl acetate homo or copolymers or even an acrylic resin. Plastisols may also contain dibutyl phthalates, mixed benzyl-butyl phthalates, di-(2-ethylhexyl) phthalates, dihexyl phthalates, diisononyl phthalates and mixtures thereof. Plastisols may optionally include styrene-acrylonitrile (SAN), acrylonitrile-butadiene-styrene (ABS), synthetic-butyl rubber (SBR) or chlorinated polyethylene (CPE). Preferably the plastisols include PVC. Conventional additives include, but are not limited to, stabilizers, fillers, pigments, blowing agents, emulsifiers, viscosity modifiers, demolding agents, antistatic agents, fungicides, thermal stabilizers, flame retardants, degassing agents, thixotropic agents and mixtures thereof. Such additives are well known to those of skill in the art. When heat is applied, the plastisol transforms into a homogeneous solid at temperatures of around 180° C.

By varying the amounts of plasticizer based on PVC polymers, several types of plastisols may be obtained. One category of plastisols is designated "soft" and exhibits a resistance to rupture of 125 kg/cm$^2$ to 165 kg/cm$^2$. A second category includes "hard" plastisols which exhibit a rupture resistance of 40 kg/cm$^2$ to 54 kg/cm$^2$. Such methods of making them are well known to those of skill in the art and may be obtained from the literature.

Plastisols may be one layer, or at least two layers, a first internal layer in contact with the plating tool and an external layer covering the internal layer adjacent the plating tool. Typically, when the plastisol has two layers, the additives are dispersed in the second layer. A plastisol composite is disclosed in EP 0607717 and includes a first layer of a standard plastisol containing 70% plasticizer and a second layer of "hard" plastisol containing 35 to 40% plasticizer. This publication also discloses a three layer plastisol composite. Two "hard" first layers and a third plastisol layer of the "soft" type covering the two "hard" layers. FR-2,456,131 filed by SERME discloses a third type of plastisol composite where the middle layer includes the additives.

The compositions which inhibit metallization may be applied to the plastisol coated plating tool at any time prior to metallization. Typically, the metallization inhibiting composition is applied to the plastisol for one to twenty minutes followed by optionally rinsing with water prior to a plating sequence. Preferably the metallization inhibiting composition is applied to the plastisol prior to etching the polymer material on the substrate.

Substrates which are secured by the plating tools during metallization typically include one or more polymers. The substrates may be metal-clad and unclad materials. Substrates also include printed circuit boards. Such printed circuit boards include metal-clad and unclad with thermosetting polymers, thermoplastic polymers and combinations thereof, including fiber, such as fiberglass, and impregnated embodiments of the foregoing.

Thermoplastic polymers include, but are not limited to, acetals, acrylics, cellulosics, polyethers, nylon, polyethylene, polystyrene, styrene blends, acrylonitrile-butadiene styrene copolymers, polycarbonates, blends of acrylonitrile-butadiene styrene copolymers and polycarbonates, polychlorotrifluoroethylene, and vinyl polymers.

Thermosetting polymers include, but are not limited to allyl phthalate, furane, melamine-formaldehyde, phenol-formaldehyde, phenol-furfural copolymers, epoxy resins, allyl resins, glyceryl phthalates and polyesters.

The metallization inhibiting compositions may be used to inhibit plating on plastisol in many conventional plating sequences where polymer containing substrates are plated by electroless metal plating. The specific treatment compositions, process steps, specific times and temperature at which the plating tool and substrate may be exposed to may vary. In general, the metallization inhibiting composition is first applied to the plastisol of the plating tool and then the substrate is secured to the plating tool. The plating tool with the substrate is then immersed or sprayed with a conventional cleaner to degrease the substrate. Various conventional commercial cleaners may be used such as CLEANER™ PM 900 cleaning solution available from Dow Electronic Materials, Marlborough, Mass. Optionally the plating tool and the substrate are rinsed with tap water.

The polymers on the substrate are then immersed or sprayed with a chromium (VI) free etch solution or low chromium (VI) etch solutions. The plastisol coated plating tool may also come in contact with the etching solution. Conventional chromium (VI) free etch solutions may be used. Typical chromium (VI) free etch solutions include, but are not limited to low-chromic acid etch solutions, Mn (VII) etch solutions as disclosed in U.S. 2011/0140035, Mn(II)/Mn(III) mixed acid etch solutions, Mn(II)/Mn(III) acid etch suspensions, permanganate based chromium (VI) free etch solutions which may include Mn(VII) and cerium (IV)/silver (I) acid etch solutions as disclosed in U.S. Pat. No. 7,780,771. In general, the low chromic acid etching solutions include chromic acid in amounts of 10 g/L to 100 g/L, sulfuric acid in amounts of from 500 g/L to 1100 g/L. Additionally, the etching solution may include one or more sources of chromium (III) ions such as chromium chloride, chromium sulfate, chromium hydroxide and chromium (III) oxide to provide 20 g/L to 50 g/L of chromium (III) ions. Instead of adding Cr(III) salts an appropriate reducing agent such as oxalic acid, hydroxylamine or hydrazine can be added to the Cr(VI) containing etching solution to generate 20 g/L to 50 g/L of chromium (III) ions. Permanganate based chromium (VI) free etch solutions are typically aqueous based solutions containing potassium permanganate and in amounts of 1 g/L to 5 g/L and concentrated sulfuric acid in amounts of 60 wt % to 90 wt %. The permanganate etch typically includes Mn (VII).

Mn(II)/Mn(III) etch compositions consist essentially of Mn(III) ions and Mn(III) ions, sulfuric acid and one or more organic acids. In the solutions the active etching agent for etching and roughening one or more polymers is the dissolved Mn(III) ions. The maximum concentrations of the Mn(III) and Mn(III) ions in solution are limited by their solubility at a given acid concentration and temperature. Minor experimentation may be done to determine the saturation concentration for a given component of the solution. One or more sources of Mn(III) and Mn(III) ions may be included in the solutions up to just below their saturation concentrations. The aqueous acid etch compositions may be suspensions or solutions. Suspensions are disclosed in U.S. Pat. No. 8,603,352. Preferably the Mn(III)/Mn(III) etch compositions are solutions where all of the solutes are substantially dissolved in the solvent. Sufficient water is added to bring the solution to 100 wt %. The amount of water added may be up to 45 wt % of the solution. The pH of the etching compositions are from less than 1 to 6.

Preferably, Mn(II) ions are at concentrations of 0.1 mmol/L to just prior to precipitation or crystallization of Mn(II) salts, more preferably the Mn(II) ions are at concentrations of 1 mmol/L to just prior to precipitation of Mn(II) salts. Most preferably the Mn(II) ions are at concentrations of 1 mmol/L to 50 mmol/L. The maximum concentration of the Mn(II) ions in solution may vary depending on the temperature and acid content of the composition; however, this may be readily determined by visual inspection of the solution followed by measuring the total Mn concentration with atomic absorption spectroscopy (AAS).

Sources of Mn(III) ions in the solutions, include, but are not limited to Mn(III)-sulfate, Mn(III)-acetate, Mn(III)-acetylacetonate, Mn(III)-fluoride, Mn(III)-methanesulfonate and Mn(III)-oxide. Such compounds are known in the art and literature and some are commercially available. They are included in the solutions in amounts to provide the desired concentrations of Mn(III) ions in the solutions.

Sources of Mn(III) ions include, but are not limited to Mn(II)-sulfate, Mn(II)-phosphate, Mn(II)-hydrogen phosphate, Mn(II)-hypophosphate, Mn(II)-carbonate, Mn(II)-oxide, Mn(II)-hydroxide, Mn(II)-halogenide, Mn(II)-nitrate, Mn(II)-acetate. Such manganese compounds are known in the art and are known in the literature and some are commercially available. They are included in the solutions in sufficient amounts to provide the desired Mn(III) ion concentrations in the solutions.

Mn(III) species may also be provided in the etching solutions chemically by using one or more Mn(III) compounds and one or more oxidizing agents. Oxidizing agents include, but are not limited to $KMnO_4$, $MnO_2$, persulfates, such as alkali metal persulfates including ammonium and OXONE®, hydrogen peroxide or other inorganic peroxides. The amount of oxidizing agent or mixtures thereof added to the solutions are added in amounts below the stoichiometric amount of the Mn(III) compounds, such that the amount of the Mn(III) ions generated is 0.01 mmol/L to a concentration just prior to precipitation of Mn(III) salts. Most preferably oxidizing agents are included in the solutions such that the Mn(II) ion concentration ranges from 1 mmol/L to 50 mmol/L.

Mn(III) ions may also be generated from Mn(II) ions by electrolysis. One or more Mn(III) compounds are added to an acidic aqueous solution including sulfuric acid one or more organic acids. The electrolysis may be conducted in a one compartment cell or in a two compartment cell where anolyte and catholyte are separated by using a membrane or porous ceramic tube or plate. The anolyte includes Mn(II) ions, sulfuric acid and one or more organic acids and the catholyte includes sulfuric acid and one or more organic acids. Conventional anodes and cathodes of various materials may be used. Electrolysis is performed until a desired amount of Mn(III) ions are produced to etch an organic polymer in preparation for subsequent metallization. Current densities may vary depending on the electrode materials and the rate of Mn(III) ion generation. Typically the current density is 0.1 $A/dm^2$ to 100 $A/dm^2$. When the Mn(III) ions fall below the desired amount, electrolysis is started again until the desired amount of Mn(III) ions in the etch solution is reached.

Optionally one or more catalysts may be added to the etch solutions when applying the electrolysis method. One or more catalysts at concentrations from 0.01 mmol/L to 1 mmol/L may be used to increase the anodic current efficiency of the Mn(II)/Mn(III) oxidation reaction and increase the etching activity of the composition. Such catalysts include, but are not limited to, Ag(I), Bi(III), Ce(III) and Pb(II) ions. Sources of such catalytic ions are known in the art and literature and many are commercially available. Additional Mn(II)/Mn(III) solutions are disclosed in U.S. 2013/0186861; U.S. 2013/0186862; and U.S. 2013/0186774.

Optionally the substrate may be treated with a neutralizer. A conventional neutralizer may be used. Such neutralizers may include one or more amines or a solution of 3 wt % peroxide and 3 wt % sulfuric acid. A commercially available neutralizer is NEUTRALIZER™ PM-955 available from Dow Electronic Materials.

The substrate is then immersed in a pre-dip solution in preparation for catalyst application. Examples of pre-dips include 25 v/v % concentrated hydrochloric acid or an acidic solution of 25 g/L to 75 g/L sodium chloride.

The catalyst may be applied by immersing the substrate with the plating tool in a catalyst solution or spraying the catalyst on the substrate. Any conventional colloidal or ionic catalyst may be used. The choice of catalyst depends on the type of metal to be deposited. Typically the catalysts are of noble and non-noble metals. Such catalysts are well known in the art and many are commercially available or may be prepared from the literature. Examples of non-noble metal catalysts include copper, aluminum, cobalt, nickel, tin and iron. Typically noble metal catalysts are used. Suitable noble metal colloidal catalysts include gold, silver, platinum, palladium, iridium, rhodium, ruthenium and osmium. Preferably, noble metal catalysts of silver, platinum, gold and palladium are used. More preferably silver and palladium are used. Suitable commercially available catalysts include, for example, CIRCUPOSIT CATALYST™ 334, CATAPOSIT™ 44 and CATAPOSIT™ PM-957 available from Rohm and Haas Electronic Materials. Ionic catalysts typically include palladium, gold and silver ions stabilized by complexing molecules such as those disclosed in U.S. Pat. No. 3,523,874 and U.S. Pat. No. 5,503,877. Optionally the substrate may be rinsed with water after application of the catalysts.

Typically the substrate is immersed in or sprayed with an accelerator such as when a colloidal palladium/tin catalyst is used. Conventional accelerators may be used. Process conditions are well known to those of skill in the art. An example of a commercial accelerator is ACCELERATOR™ PM-964 solution available from Dow Electronic Materials. When an ionic palladium catalyst is used the substrate is immersed in or sprayed with a reducing solution. Conventional reducing solutions containing hypophosphite or dimethylamino borane may be used. Such reducing agents are well known in the art and disclosed in the literature. Optionally, the substrate is rinsed with water.

The catalyzed substrates are then plated with metal from conventional electroless metal plating baths such as copper and nickel baths. Plating times and temperatures are disclosed in the literature or are well known to those of skill in the art. The plastisol coating of the plating tool which comes in contact with the electroless metal plating bath during electroless plating is substantially free of metal deposit.

Accordingly, the plating tool does not have to be cleaned of any unwanted metal on its surface and the plating tool can be immediately used for plating the next substrate. If any unwanted electroless plating occurs in subsequent process steps, the metal is removed and the metallization inhibiting treatment with sulfur compounds is renewed.

Treating the plastisol coated plating tools with a composition containing one or more sulfur compounds containing a sulfur atom in an oxidation state equal to −1 or −2 inhibits unwanted metallization of the plastisol coated plating tools. In addition, the methods may be used with etching solutions which exclude carcinogens such as chromium (VI) and are more environmentally friendly.

The following examples are not intended to limit the scope of the invention but are intended to further illustrate it.

Example 1 (Comparative)

JIG Metallization of Plastisol Material Treated with Cr(VI)-Free Etching Solution Based on Mn(III) and Colloidal Pd-Catalyst A mounting rack coated with PVC containing plastisol was immersed in CLEANER™ PM-900 cleaning solution (available from Dow Electronic Materials) at a temperature of 50° C. for 5 minutes with ultrasonic agitation. The rack was then immersed in an etching solution having the formulation in Table 1 below.

TABLE 1

| COMPONENT | AMOUNT |
|---|---|
| Manganese Sulfate Monohydrate | 1.69 g/L |
| Manganese (III) ions | 2.75 g/L |
| Sulfuric acid (96 wt %) | 631 g/L |
| Methane sulfonic acid (70 wt %) | 863 g/L |
| Silver sulfate | 360 mg/L |
| Water | Balance |

The rack was immersed in the etch solution at 65° C. in a two compartment electrolytic cell with a porous ceramic tube joining the two compartments. The electrolytic cell included a platinized titanium anode and a platinum cathode. A current density of 8 ASD was applied to the etch solution to oxidize any manganese (II) ions back to manganese (III) ions during the etching process. Etching was done for 15 minutes.

After etching, the rack was then immersed in a pre-dip solution of 250 mL/L of aqueous concentrated hydrochloric acid at ambient conditions for 1 minute. The rack was then immersed in CATAPOSIT™ PM-957 palladium catalyst solution (available from Dow Electronic Materials) at 30° C. for 3 minutes. The palladium catalyst included 35 ppm of palladium metal. The rack was then immersed in ACCELERATOR™ PM-964 solution (available from Dow Electronic Materials) at 45° C. for 5 minutes.

The rack was immersed in NIPOSIT™ PM-980 electroless nickel plating solution (available from Dow Electronic Materials) at 30° C. for 10 minutes. The rack was rinsed with tap water at room temperature. The rack was coated with nickel. There was no indication that the etching solution inhibited nickel plating on the rack.

Example 2 (Comparative)

Jig Metallization of Plastisol Material Treated with Cr(VI)-Free Etching Solution Based on Permanganate/Sulfuric Acid and Colloidal Pd-Catalyst The method described in Comparative Example 1 was repeated except the etching solution had the formulation as shown in Table 2 below and no anodic oxidation was done.

TABLE 2

| COMPONENT | AMOUNT |
|---|---|
| Potassium permanganate | 2 g/L |
| Sulfuric acid (85%) | balance |

After plating approximately 50% of the rack surface was plated with electroless nickel. Although the rack was not completely coated with nickel as in Comparative Example 1, it was still substantially coated with nickel.

Example 3 (Comparative)

JIG Metallization of Plastisol Material Treated with Cr(VI)-Free Etching Solution Based on Mn(III) and Ionic Pd Catalyst A mounting rack coated with PVC containing plastisol was immersed in CLEANER™ PM-900 cleaning solution at a temperature of 50° C. for 5 minutes with ultrasonic agitation. The etching method described in Example 1 was repeated.

After etching, the rack was then immersed in 1 g/L solution of potassium carbonate at room temperature for 1 minute. The rack was then immersed in an aqueous ionic palladium catalyst solution containing 2.5 g/L palladium nitrate, 1 g/12,6-dimethylpyrazine and 4.5 g/L potassium carbonate at 40° C. for 5 minutes. Afterwards the substrate was immersed into a solution containing 2 g/L boric acid and 0.6 g/L dimethylamino borane.

The rack was immersed in NIPOSIT™ PM-980 electroless nickel plating solution at 30° C. for 10 minutes. The rack was rinsed with tap water at room temperature. The rack was substantially coated with nickel. There was no indication that the etching solution inhibited nickel plating on the rack.

Example 4 (Comparative)

JIG Metallization of Plastisol Material Treated with Low-Chromic Acid Etching Solution with Colloidal Pd-Catalyst A mounting rack coated with PVC containing plastisol was immersed in CLEANER™ PM-900 cleaning solution at a temperature of 50° C. for 5 minutes with ultrasonic agitation. The cleaned rack was then immersed in a low chromic acid etching solution which was prepared according the formulation in Table 4 below which resulted in a chromium (VI) containing solution comprising 75 g/L chromic acid, 700 g/L sulfuric acid 96 wt % and 30 g/L Cr(III) ions.

TABLE 4

| COMPONENT | AMOUNT |
|---|---|
| $CrO_3$ | 132 g/L |
| Oxalic acid dihydrate | 110 g/L |
| Sulfuric acid 96 wt % | 700 g/L |

The rack was immersed in the etch solution at 74° C. for 15 minutes.

After etching, the rack was then immersed in NEUTRALIZER™ PM-955 solution (available from Dow Electronic Materials) at 55° C. for 3 minutes followed by immersing the rack in CLEANER CONDITIONER™ 1110A solution (available from Dow Electronic Materials) at 65° C. for 3 minutes. The rack was then immersed in a pre-dip solution of 250 mL/L of concentrated hydrochloric acid at room temperature for 1 minute. The rack was then immersed in CATAPOSIT™ PM-957 palladium catalyst solution at 30° C. for 3 minutes. The rack was then immersed in ACCELERATOR™ PM-964 solution at 45° C. for 5 minutes.

The rack was immersed in NIPOSIT™ PM-980 electroless nickel plating solution at 30° C. for 10 minutes. The rack was rinsed with tap water at room temperature. The entire rack was coated with nickel.

Example 5 (Comparative)

JIG Metallization of Plastisol Material Treated with Cr(VI)-Free Etching Solution Based on Mn(III) and Colloidal Ag Catalyst A mounting rack coated with PVC containing plastisol was immersed in CLEANER™ PM-900 cleaning solution at a temperature of 50° C. for 5 minutes with ultrasonic agitation. The etching method described in Example 1 was repeated.

After etching, the rack was then immersed in an aqueous colloidal silver catalyst solution containing 100 ppm of silver ions from silver nitrate. The aqueous colloidal catalyst was prepared from a stock solution containing 300 ppm of silver ions from 470 ppm of silver nitrate, 150 ppm of gallic acid and sufficient amounts of sodium hydroxide to adjust the pH to 2.9. The rack was left in contact with the catalyst at 45° C. for 7 minutes.

The rack was immersed in CIRCUPOSIT™ electroless copper plating solution at 42° C. for 10 minutes. The rack was rinsed with tap water at room temperature. The rack was approximately 50% coated with copper.

Example 6

Thiol-Compound as Metallization Inhibitor for Plastisol Materials when Used with Cr(VI)-Free Etching Solution Based on Mn(III) and Colloidal Pd-Catalyst The mounting rack from Example 1 was immersed into concentrated nitric acid solution for approximately 30 seconds to dissolve the nickel deposit from the plastisol. Afterwards the rack was rinsed thoroughly with tap water at room temperature. The rack was immersed at room temperature into a hexane solution containing 75 g/L of octadecyl-3-mercaptopropionate for 15 minutes. The rack was taken out of the solution and adherent solvent was evaporated in a fume hood. The rack was subjected to the etching and plating sequence described in Example 1. After electroless nickel plating the rack was rinsed thoroughly with tap water at room temperature. Except on the thinly coated plastisol arms the remainder of the rack was free of any observable nickel deposits.

Example 7

Thiol-Compound as Metallization Inhibitor for Plastisol Materials when Used with Cr(VI)-Free Etching Solution and Colloidal Pd-Catalyst A new plastisol coated stainless steel rod was immersed 12 cm deep into a water-based emulsion containing 50 g/L octadecanethiol and 38 g/L of an ethoxylated T-dodecyl mercaptan as emulsifier at 50° C. After 15 minutes the rod was taken out of the emulsion and excess emulsifier and thiol were rinsed away with cold tap water. The rod was subjected to the etching and plating method described in Example 1. The rod was immersed 15 cm into the electroless nickel plating bath. After plating the rod was rinsed with tap water. The region of the rod coated with plastisol and which was not treated with octadecanethiol was metalized while the portions of the rod treated with the thiol were free of any visible metallization.

Example 8

Thiol-Compound as Metallization Inhibitor for Plastisol Materials when Used with Cr(VI)-Free Etching Solution Based on Mn(III) and Ionic Pd-Catalyst The mounting rack from Example 3 was immersed into concentrated nitric acid solution for approximately 30 seconds to dissolve the nickel deposit from the plastisol and remaining palladium catalyst. Afterwards the rack was rinsed thoroughly with tap water. The rack was immersed for 15 minutes into a water-based emulsion containing 50 g/L octadecane-3-mercapto-propionate and 38 g/L of an ethoxylated T-dodecyl mercaptan as emulsifier at 50° C.

After 15 minutes the rack was taken out of the emulsion and excess emulsifier and inhibitor were rinsed away with cold water. The rack was subjected to the etching and plating method as in Example 3. After electroless nickel plating the rack was rinsed thoroughly with tap water. The rack was free of any visible nickel deposits.

Example 9

Thiol-Compound as Metallization Inhibitor for Plastisol Materials when Used with Low-Chromic Acid Etching Solution The mounting rack from Example 4 was immersed into concentrated nitric acid solution for approximately 30 seconds to dissolve nickel deposit from plastisol and remaining palladium catalyst. Afterwards the rack was rinsed thoroughly with tap water. The rack was immersed for 15 minutes into a water-based emulsion containing 50 g/L octadecane-3-mercapto-propionate and 38 g/L of an ethoxylated T-dodecyl mercaptan as emulsifier at 50° C. After 15 minutes the rack was taken out of the emulsion and excess of emulsifier and inhibitor were rinsed away with cold water. The rack was subjected to etching and plating as in Example 4. After electroless nickel plating the rack was rinsed thoroughly with tap water. The portions of the rack which were treated with the thiol were free of nickel deposit.

Example 10

Thiol-Compound as Metallization Inhibitor for Plastisol Materials when Used with Cr(VI)-Free Etching Solution Based on Permanganate Ions and Colloidal Pd Catalyst The mounting rack from Example 2 was immersed into concentrated nitric acid solution for approximately 30 seconds to dissolve nickel deposit from the plastisol and any remaining palladium catalyst. The rack was rinsed thoroughly with tap water and immersed for 10 minutes into a water-based emulsion containing 50 g/L octadecane-3-mercapto-propionate and 38 g/L of an ethoxylated T-dodecyl mercaptan as emulsifier at 50° C. After 10 minutes the rack was taken out of the emulsion and excess emulsifier and thiol were rinsed away with cold tap water. The rack was then etched and plated as in Example 2. After electroless nickel plating the rack was rinsed thoroughly with tap water. The rack was substantially free of any nickel deposits except on the thinly coated plastisol arms where the plastic parts are mounted.

Example 11

Thiol-Compound as Metallization Inhibitor for Plastisol Materials when Used with Cr(VI)-Free Etching Solution Based on Mn(III) and Colloidal Ag Catalyst The mounting rack from Example 5 was immersed into concentrated nitric acid solution for approximately 30 seconds to dissolve copper deposit from plastisol and remaining silver catalyst. The rack was rinsed thoroughly with tap water. The rack was immersed for 5 minutes into a water-based emulsion containing 50 g/L octadecane-3-mercapto-propionate and 38 g/L of an ethoxylated T-dodecyl mercaptan as emulsifier at 50° C. After 10 minutes the rack was taken out of the emulsion and excess emulsifier and thiol were rinsed away with cold tap water. The rack was subjected to etching and plating as in Example 5. The rack was rinsed thoroughly with tap water. The rack appeared free of any copper deposit.

What is claimed is:

1. A method comprising:

a) providing a plating tool comprising plastisol;

b) applying a composition comprising one or more surfactants having an HLB of 5 to 15 and a sulfur compound containing a sulfur atom in an oxidation state equal to −1 or −2 or a mixture of sulfur compounds having sulfur atoms with oxidation states of −1 and −2 to the plastisol;

c) fastening a substrate comprising one or more polymers to the plating tool;

d) etching the one or more polymers with a chromium (VI) free etch composition or a low chromic acid etch composition;

e) applying a catalyst to the one or more polymers; and f) electroless plating a metal on the one or more polymers.

2. The method of claim 1, wherein the sulfur compound containing the sulfur atom in an oxidation state equal to −1 is chosen from one or more disulfides.

3. The method of claim 2, wherein the one or more disulfides are chosen from di-n-allyl-disulfide, di-n-hexyl-disulfide, di-isopropyl-disulfide, isopentyl disulfide, tert-heptyl disulfide, di-octyl-disulfide, di-undecyl disulfide, di-dodecyl disulfide, di-hexadecyl disulfide, octadecyl disulfide, bis(16-hydroxyhexadecyl) disulfide, bis(11-cyanoundecyl) disulfide, bis-(3-sulfopropyl)-disulfide (SPS), diphenyl-disulfide, dibenzyl disulfide, benzyl methyl disulfide, PEG-propionate disulfide, furfuryl disulfide, thiram, and disulfiram.

4. The method of claim 1, wherein the sulfur compound containing the sulfur atom in an oxidation state equal to −2 is chosen from one or more of thiols, thioethers, thiourethanes, dithiocarbamtes, thioester, dithioesters, thioureas, thioamides, and aromatic heterocyclic sulfur containing compounds.

5. The method of claim 4, wherein the sulfur compound containing the sulfur atom in an oxidation state equal to −2 is chosen from one or more thiols.

6. The method of claim 5, wherein the one or more thiols comprise hydrophobic segments of 4 to 36 carbon atoms.

7. The method of claim 6, wherein the one or more thiols comprise hydrophobic segments of 8 to 18 carbon atoms.

8. The method of claim 1, wherein the sulfur compound containing the sulfur atom in an oxidation state equal to −1 or −2 or a mixture of sulfur compounds having sulfur atoms with oxidation states of −1 and −2 ranges from 0.1 g/L to 200 g/L.

9. The method of claim 1, wherein the composition further comprises one or more organic solvents.

10. The method of claim 1, wherein the chromium (VI) free etch composition is chosen from cerium (IV)/silver (I) acid etch, Mn (VII) etch and Mn(II)/Mn(III) acidic etch.

11. The method of claim 1, wherein the catalyst comprises a colloidal catalyst or ionic catalyst.

12. The method of claim 1, wherein the plastisol comprises polyvinyl chloride, dibutyl phthalates, mixed benzyl-butyl phthalates, di-(2-ethylhexyl) phthalates, dihexyl phthalates, diisononyl phthalates, styrene-acrylonitrile, acrylonitrile-butadiene-styrene, synthetic-butyl rubber, chlorinated polyethylene or mixtures thereof.

* * * * *